US005975217A

United States Patent [19]

Frenzel et al.

[11] Patent Number: 5,975,217

[45] Date of Patent: Nov. 2, 1999

[54] TOOL FOR DRILLING AND/OR CHISELING

[75] Inventors: Jens Frenzel, Fürstenfeldbruck; Helmut Nussrainer, Isen; Reinhard Schulz; Hans-Werner Bongers-Ambrosius, both of München, all of Germany

[73] Assignee: Hilti Aktiengesellschaft, Schaan, Liechtenstein

[21] Appl. No.: 09/056,588

[22] Filed: Apr. 7, 1998

[30] Foreign Application Priority Data

Apr. 7, 1997 [DE] Germany ..... 197 14 288

[51] Int. Cl.[6] ..... B25D 11/04

[52] U.S. Cl. ..... 173/201; 173/109; 173/212

[58] Field of Search ..... 173/201, 48, 104, 173/109, 210, 212

[56] References Cited

U.S. PATENT DOCUMENTS

| | | | |
|---|---|---|---|
| 4,113,035 | 9/1978 | Stiltz et al. | 173/201 |
| 4,442,906 | 4/1984 | Simpson | 173/48 |
| 4,567,951 | 2/1986 | Fehrle et al. | 173/201 |
| 5,111,890 | 5/1992 | Ranger et al. | 173/104 |
| 5,435,397 | 7/1995 | Demuth | 173/201 |
| 5,775,440 | 7/1998 | Shinma | 173/109 |
| 5,873,418 | 2/1999 | Arakawa et al. | 173/201 |

*Primary Examiner*—Scott A. Smith
*Attorney, Agent, or Firm*—Brown & Wood

[57] ABSTRACT

A tool for drilling and/or chiseling has a striking mechanism (6) within a guide tube (9) for reciprocating a first piston (7) and, via an air cushion, for reciprocating a second piston (19) within the guide tube. The second piston drives a driving anvil (17) in the driving direction. Between the first and second pistons (7, 19) the guide tube (9) has a series of radially extending first air passages (10) arranged in a first plane (E1) extending perpendicularly of the driving direction. A control body can be shifted over the guide tube (9) and is connected to the driving anvil (17). The guide tube (9) has a second series of radially extending second air passages (11) therethrough arranged in a second plane (E2) spaced from the first plane (E1) at a distance (A) opposite to the driving direction.

6 Claims, 4 Drawing Sheets

TOOL FOR DRILLING AND/OR CHISELING

BACKGROUND OF THE INVENTION

The invention is directed to a tool for drilling and/or chiseling and has a guide tube located in a housing with a striking mechanism located in the guide tube. The striking mechanism includes a first piston positioned in the guide tube for reciprocating movement in the axial direction of the tube and a second piston located forwardly of the first piston with an air cushion formed between the two piston. The guide tube has a series of first air passages in the range of the tube between the first and second pistons. The air passages are of the same cross section and are distributed in a first plane around the guide tube. A control body interacts with a driving anvil driven by the second piston and is arranged to cover the first air passages.

German Offenlegungsschrift 39 32 134 discloses a chiseling tool having a guide tube in which a piston of a striking mechanism and a second piston, interacting with a driving anvil are axially displaceably arranged. Between the two pistons, the guide tube has several radially extending air passages distributed around the periphery in a plane extending perpendicularly to the axially extending working direction of the tool. The air passages can be covered by a control body reciprocally displaceable in the working direction relative to the guide tube.

The control body is in the form of a sleeve and surrounds the guide tube. In an end region of the control body, located opposite to the working direction, the control body has several radially extending ventilation openings distributed around its periphery in a plane extending perpendicularly to the working direction. The ventilation openings are arranged in the control body, so that they can be made to coincide with the air passages when the control body is shifted back and forth relative to the guide tube. The cross sectional area of each ventilation opening corresponds essentially to half the cross sectional area of each air passage in the guide tube.

In operation, the tool must be pushed against a receiving material, that is a material to be worked by the tool. In this connection, the tool is supported against the receiving material by the chiseling member. While the tool is pressed against the receiving material, the tool, the driving anvil and the control body are shifted opposite to the working direction relative to the tool. At the same time, the control body assumes three different positions.

Before the tool is pressed against the receiving material, the control body is positioned relative to the guide tube in the working direction so that the air passages are not closed by the control body.

In a first contacting position, the ventilation openings cover the air passages in the guide tube. Although the interior of the guide tube between the two pistons is ventilated over the small ventilation openings, an air cushion is built up between the pistons affording the development of a small pressure sufficient to shift the leading piston with a small velocity in the working direction.

In a second contacting position, the air passages are completely covered by the control body. Between the two pistons, an air cushion having a higher pressure can develop. With the aid of this air cushion, the leading piston can be shifted in the working direction at high speed.

While the tool is being transported, drilled materials or other dirt particles which have collected on the outer circumferential region of the guide tube can be knocked loose into the interior of the guide tube through the open air passages. If the tool is started up again such drilled material or dirt particle can lead to damage to the leading piston, the trailing piston or the inner wall of the guide tube.

SUMMARY OF THE INVENTION

Therefore, a primary object of the present invention is to provide a drilling and/or chiseling tool which can be manufactured economically and simply, so that it has a long service life and contamination of the interior of the guide tube is prevented.

In accordance with the present invention, the guide tube is provided with a second series of radially extending air passages distributed around the periphery of the guide tube in a second plane spaced from the first plane opposite to the working direction of the tube and the two planes extend substantially parallel to one another.

Due to the arrangement of the additional or second air passages, it is possible to make the cross sectional areas of the individual air passages very small for effectively preventing penetration of drilled material or dirt particles into the guide tube. Furthermore, a slight ventilation of the inside of the guide tube is it possible over the second air passages, if the tool is in a first contacting position and the first air passages are closed by the control body. Although the inside of the guide tube is ventilated slightly by the additional or second air passages, the build up of an air cushion, for reciprocating a second piston back and forth with a slow velocity, is possible.

So that the pressure of the air cushion which can be built up in the first contacting position corresponds substantially to half the pressure of the air cushion which can be built up in the second contacting position, the second air passages are preferably distributed over the periphery of the guide tube in additional planes. The second piston is accelerated slowly, especially when the tool is started up and, when the tool is lifted from the surface of the material being worked the velocity of the second piston being reciprocated, is decreased.

For manufacturing reasons, the additional air passages are advantageously distributed uniformly around the guide tube.

To gain uniform ventilation of the inside of the guide tube through the additional air passages, preferably all of such air passages have the same cross section. To prevent drilled material or other dirt particles from reaching the inside of the guide tube through the first air passages or the additional or second air passages, the cross section of each additional air passage advisably corresponds essentially to the cross section of the first air passages.

A further decrease in the cross section of the first air passages and of the further second air passages can be attained owing to the fact that the additional planes with the second air passages are distributed around the periphery of the guide tube and adjoin the plane of the first air passages and are spaced opposite to the working direction of the tool. The additional air passages in the additional planes are also closed by the control body which can be displaced by the reciprocating action of the second piston.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
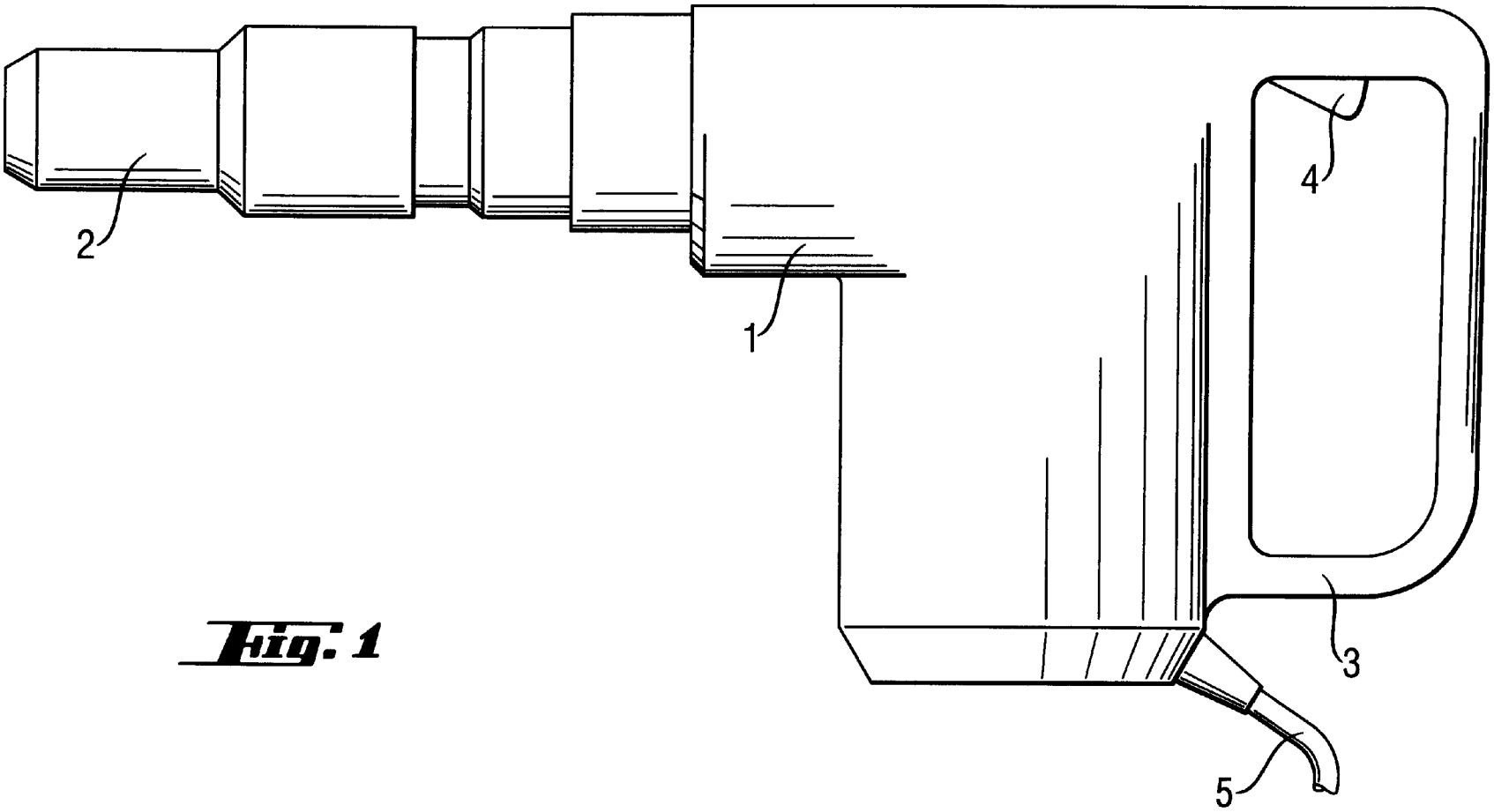
FIG. 1 is a diagrammatic side elevational view of a tool embodying the present invention but without a drilling or chiseling bit.

The drilling and/or chiseling tool, shown diagramatically in FIG. 1, has a housing 1 with a handle 3 at its right hand end, an operating switch 4 in the handle, an operating bit chuck 2 for a bit, not shown, at the left hand end, and an electric cable 5 for connecting the tool to an external power supply.

Figure 2:
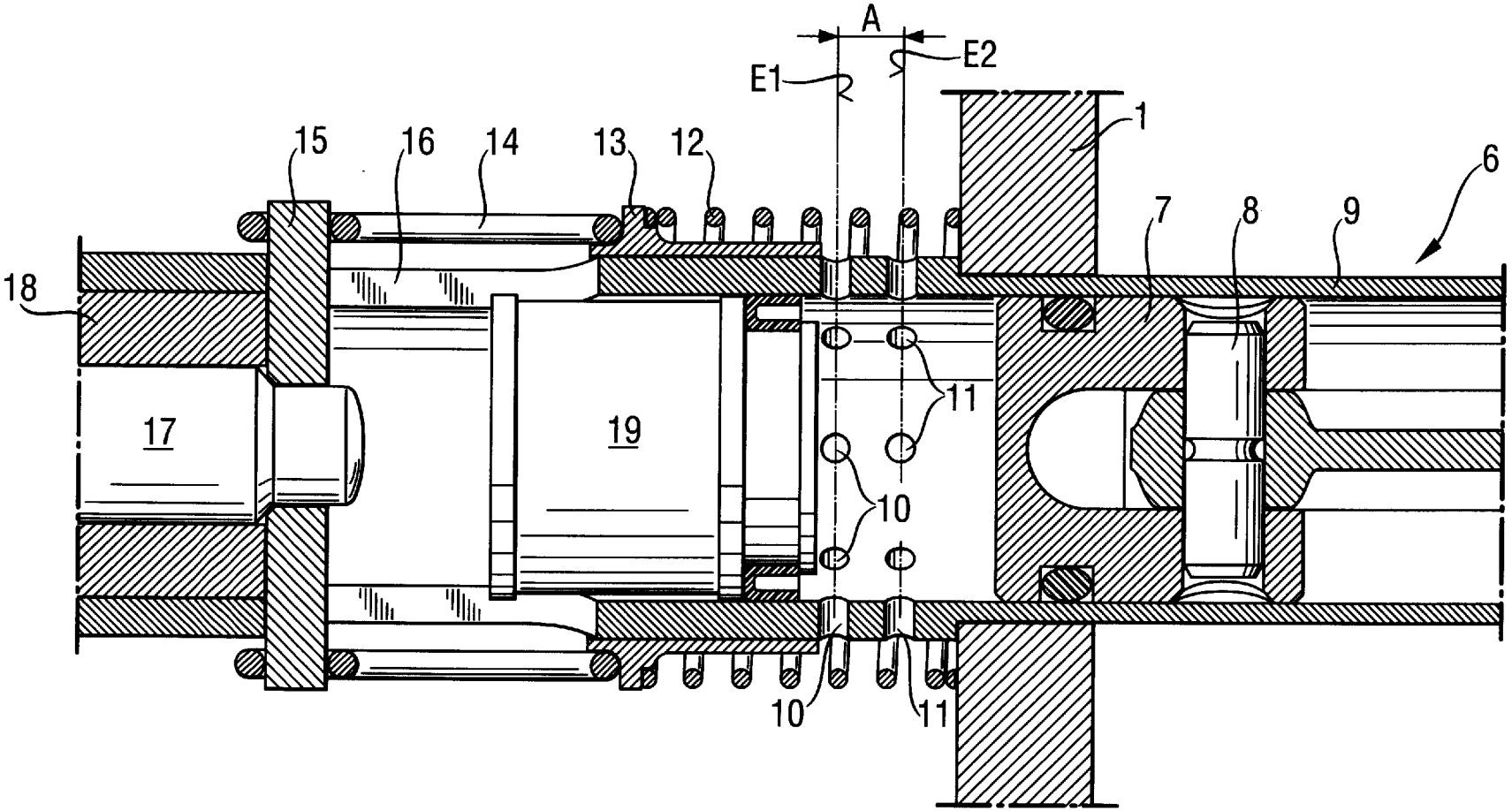
FIG. 2 is an axially extending sectional view of a part of the guide tube of the tool in FIG. 1 with the control body in a basic or non-contacting position.
Figure 3:
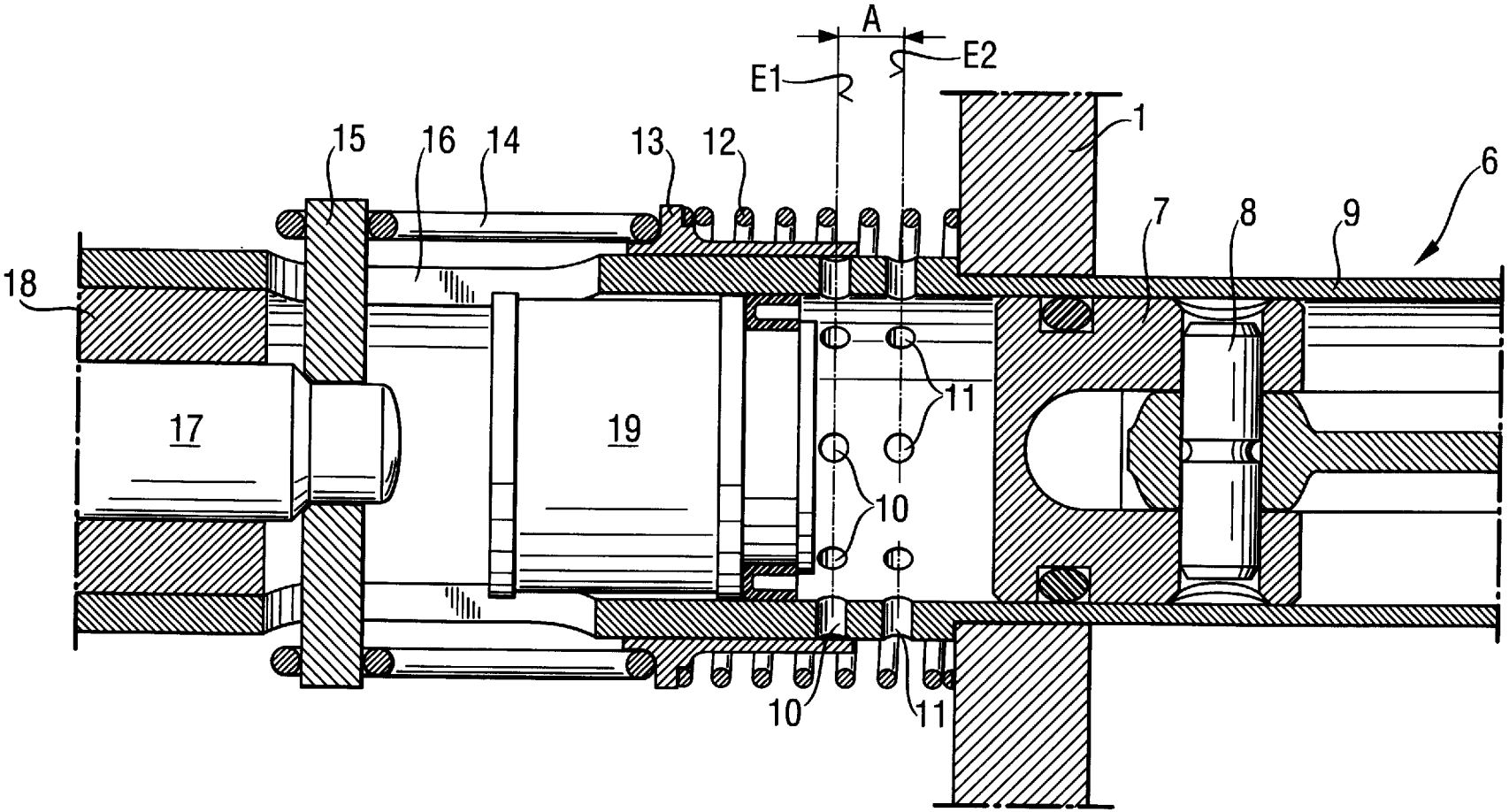
FIG. 3 is a view similar to FIG. 2 with the tool in a first contacting position.
Figure 4:
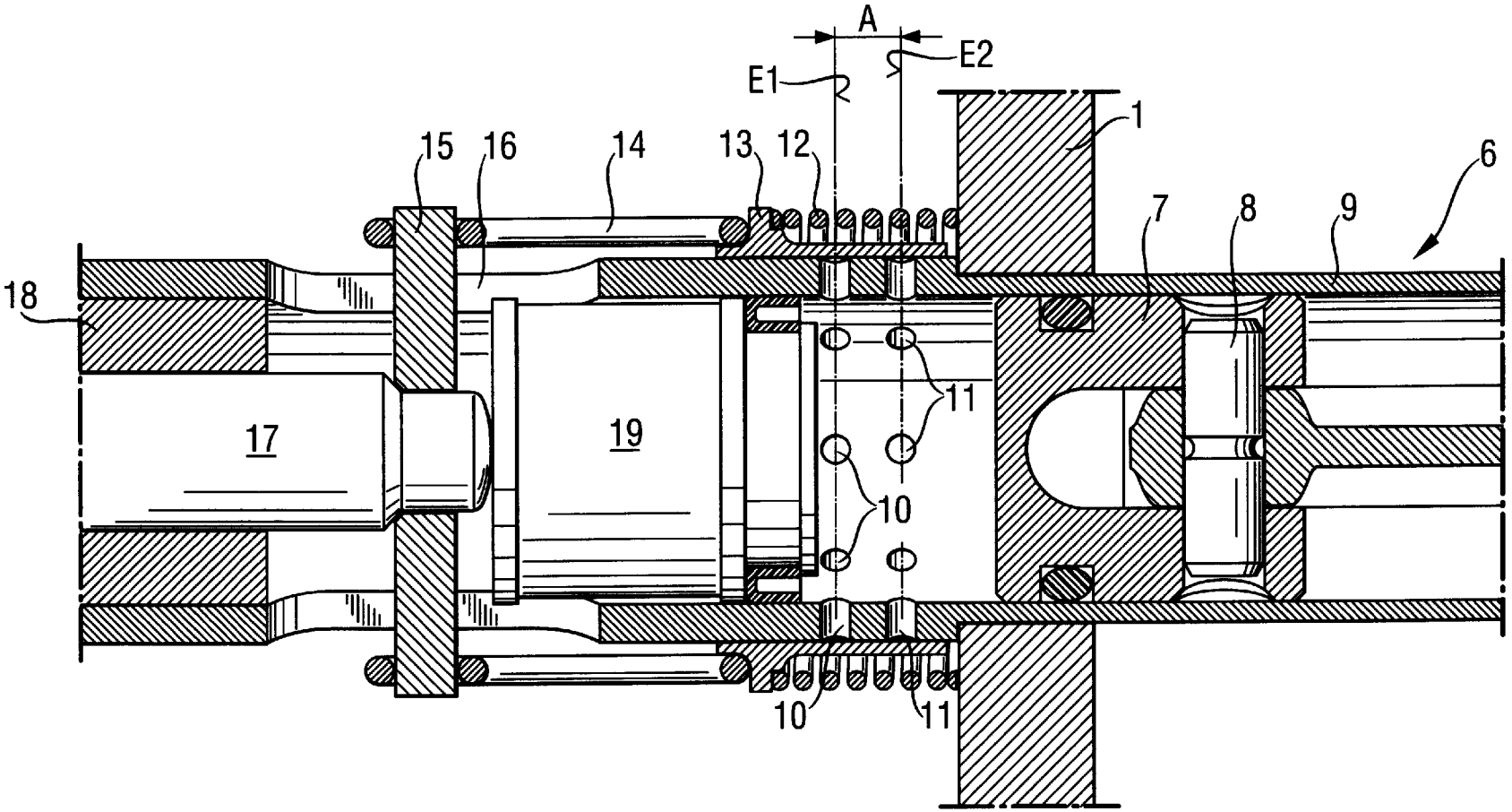
FIG. 4 is a view similar to FIGS. 2 and 3 with the tool in a second contacting position.

In FIGS. 2–4, an axially extending guide tube 9 is mounted in and extends axially outwardly from the housing 1 and its axial direction corresponds to the working direction. The guide tube 9 has a first end facing in the working direction, that is to the left in FIGS. 2–4 and a second end facing in the opposite direction located in the interior of the tool housing. A conventional striking mechanism 6, shown only in part, is located toward the second end of the guide tube and includes a first piston 7 arranged to be moved reciprocally and axially displaceable in the guide tube. The first piston 7 is connected by a bolt 8 with a piston rod, shown only in part, which extends toward the second end of the guide tube opposite to the working direction.

Between the first piston 7 and the first end of the guide tube 9 there is a second piston 19 which reciprocates back and forth and contacts a trailing end of a striking or driving anvil 17. The second piston 19 is reciprocated by means of an air cushion which can be developed between the facing surfaces of the first and second pistons 7, 19. The guide tube 9 has a number of radially extending first air passages 10 and a number of radially extending second air passages 11 communicating with the air cushion space between the two pistons. The first air passages 10 are arranged around the periphery of the guide tube in a first plane El and the second air passages are distributed around the periphery in a second plane E2 with the second plane E2 spaced at a distance A from the first plane El in the direction opposite to the working direction.

The first air passages 10 and the second air passages 11 are controlled or closed by a control body which can be shifted or reciprocated relative to the guide tube 9 by the driving anvil 17 with the anvil moving the control body opposite to the working direction and with a spring 12 encircling the guide tube moving the control body in the working direction. The driving anvil 17 is guided in a guide sleeve 18 axially connected with the guide tube 9. The spring 12 extends around the outside of the guide tube 9 and is supported at its trailing end against the housing 1 and at its leading end against a shoulder of a connecting sleeve 13. The connecting sleeve 13 extends around the outer periphery of the guide tube but inwardly of the spring 12.

The control body is formed by a shift fork 15, a sliding shifter member 14 and the connecting sleeve 13. The shift fork 15 is engaged with the trailing end of the driving anvil 17 within the guide tube 9 and extends radially outwardly through diametrically opposite openings 16 in the guide tube. The radially outer ends of the shift fork 15 are in positive connection with the shifter member 14 constructed as a wire hoop. A portion of the shifter member 14 is shaped semicircularly and engages in a recess formed by an outwardly projecting shoulder at the leading end of the connecting sleeve 13. The opposite end of the shifter member 14 extends in the working direction and positively grasps the radially outer ends of the shift fork 15.

FIG. 2 shows the control body in its basic position, that is, the tool is not in a contact position with a receiving material to be worked. The first air passages 10 and the second air passages are open, that is, they are not covered by the connecting sleeve 13, and the two series of air passages 10, 11 are spaced apart at a distance A. The ventilation of the inside of tube 9 through the first and second 10, 11 is such that the first piston 7 cannot develop an air cushion and shift the second piston 19 into a working position.

FIG. 3 shows the control body in a first contact position such that the tool initially contacts the receiving material to be worked, as shown. The first contact position is reached after half the contacting path has been covered. In this position the driving anvil 17 is shifted opposite to the working direction during the contacting operation and causes the control body to be shifted in the same direction. The connecting sleeve 13 of the control body covers all of the first air passages 10. In this position, the additional or second air passages 11 remain open. Accordingly, a low pressure air cushion can be developed by the first piston 7, that is, the air cushion pressure between the first and second pistons is partially developed. This partial air cushion pressure is sufficient to shift the second piston 19 at a low velocity in the working direction.

In FIG. 4 the control body is in the further contact position reached after the tool has been completely pressed against the receiving material to be worked. The connecting sleeve 13 of the control body displaced opposite to the working direction now covers all of the first and second air passages 11. The inside of the guide tube 9 is no longer ventilated. Due to the reciprocating action of the first piston 7 the second piston 19 can be axially displaced at a high velocity in the working direction.

While specific embodiments of the invention have been shown and described in detail to illustrate the inventive principles, it will be understood that the invention may be embodied otherwise without departing from such principles.

We claim:

1. A tool for at least one of drilling and chiseling comprises a housing (1), an axially extending guide tube (9) mounted in said housing and having a leading end and a trailing end spaced apart in the axial direction of said guide tube, a striking mechanism (6) mounted in said guide tube towards the trailing end thereof and includes a first piston (7) guided by said guide tube for reciprocating movement in the axial direction of said guide tube (9), a second piston (19) located within said guide tube and spaced from said first piston in the axial direction of said guide tube towards the leading end thereof for forming an air cushion within said guide tube between said first and second pistons, a driving anvil (17) located within said guide tube (9) on the opposite side of said second piston from said first piston (7) and arranged to be driven by said second piston as said first piston is reciprocated and said second piston is correspondingly reciprocated via said air cushion, said guide tube (9) having a series of first air passages (10) of the same cross section extending radially therethrough in a first plane (E1) arranged perpendicularly of the axial direction of said guide tube, a control body axially displaceable in the axial direction of said guide tube and arranged to selectively cover said first air passages (10), said control body interacting with said driving anvil (17) for displacement in the axial direction, said guide tube (9) having additional radially extending second air passages (11) therethrough located in at least one second plane (E2) spaced from first plane (E1) and located closer to said first piston (7) with said planes (E1, E2) arranged substantially parallel to one another.

2. A tool, set forth in claim 1, wherein said second air passages (11) are arranged around said guide tube (9) in one second plane (E2).

3. A tool, as set forth in claim 2, wherein said second air passages (11) are distributed uniformly around the periphery of said guide tube (9).

4. A tool, as set forth in claim 1, 2 or 3, wherein all of said second air passages (11) have the same cross section.

5. A tool, as set forth in claim 4, wherein the cross section of each said second air passages (11) corresponds substantially to the cross section of each said first air passages (10).

6. A tool, as set forth in claim 1, wherein said control body comprises a shift fork (15) secured to an end of said driving anvil contacted by said second piston (19), said shift fork extending radially outwardly through axially extending slot-like openings in said guide tube, a shifter member (14) secured to radially outer ends of said shift fork (15) and extending in the axial direction of said guide tube toward the trailing end thereof, a connecting sleeve (13) in slidable contact with an outer surface of said guide tube and displaceable along said guide tube between a first position spaced from said first and second passages to a second position covering and enclosing said first and second air passages, and an axially extending spring member (12) in contact at one end with said housing and in contact with another end with said connecting sleeve (13) for moving said sleeve toward the position where it does not cover said first and second air passages (10, 11).

* * * * *